United States Patent [19]

Spanel

[11] 3,937,643

[45] Feb. 10, 1976

[54] METHOD AND MEANS OF TUFTING

[76] Inventor: Abram N. Spanel, 344 Stockton St., Princeton, N.J. 08540

[22] Filed: Dec. 23, 1974

[21] Appl. No.: 535,804

Related U.S. Application Data

[63] Continuation-in-part of Ser. No. 419,417, Nov. 27, 1973, which is a continuation of Ser. No. 239,931, March 31, 1972, abandoned.

[52] U.S. Cl. ..... 156/435; 156/72

[51] Int. Cl.[2] ..... D04H 11/00

[58] Field of Search ..... 156/72, 435; 112/79 R, 112/79 FF, 79 A, 262; 83/402, 100; 139/7, 2

[56] References Cited

UNITED STATES PATENTS

| | | | |
|---|---|---|---|
| 3,278,363 | 10/1966 | Couquet | 156/72 |
| 3,554,147 | 1/1971 | Spanel | 112/79 R |
| 3,595,186 | 7/1971 | Shorrock et al. | 112/79 |
| 3,670,672 | 6/1972 | Spanel et al. | 112/79 R |
| 3,697,344 | 10/1972 | Temple | 156/72 |
| 3,756,173 | 9/1973 | Shorrock | 112/79 FF |
| 3,824,939 | 7/1974 | Spanel et al. | 112/79 FF |
| R27,165 | 8/1971 | Spanel et al. | 112/79 R |

*Primary Examiner*—Douglas J. Drummond
*Assistant Examiner*—Michael W. Ball
*Attorney, Agent, or Firm*—Steele & Petock

[57] ABSTRACT

A tufting machine having multi-color selection capability for each tufting cycle which utilizes pneumatic pressure, either positive or negative, or a combination of the two, to transfer the yarn or other tufting material to tufting elements. The system comprises yarn guide passageways having abutting sections which are relatively movable to create an opening through which a yarn severing means severs the yarn into selectively-sized bit lengths. The relative positions of the yarn severing means and the abutting sections of the passageways are adjustable to provide yarn bit lengths of selectable varying lengths. A combination bit applying element and clamp means is utilized to apply the yarn to an adhesive bit gripping surface on the backing layer. In the preferred embodiment, this application occurs before the yarn is severed and thus the yarn is effectively clamped at the time of severance. After severance, the combination bit-applying and clamp means retracts, permitting the backing layer to be advanced preparatory to the next tufting cycle.

6 Claims, 7 Drawing Figures

METHOD AND MEANS OF TUFTING

CROSS REFERENCE TO RELATED APPLICATIONS

This application is a continuation-in-part of my earlier application Ser. No. 419,417, filed Nov. 27, 1973, which is a continuation of an earlier application Ser. No. 239,931, filed Mar. 31, 1972, both of which are entitled "Method and Means of Tufting."

SUMMARY OF THE INVENTION

The present invention relates to tufting of rugs and carpets and the like, and utilizes a pneumatic system which may be used in various types of tufting systems. However, it has particular utility in the Spanel et al multi-color selection system described below.

The present invention offers modifications to some embodiments disclosed in U.S. Patent No. Re. 27,165 which issued to Abram N. Spanel on Aug. 10, 1971, and Pat. No. 3,554,147, which issued on Jan. 12, 1971, to Abram N. Spanel.

The latter patents disclose a pneumatic system in which yarn strands and/or discrete bits of yarn are transported pneumatically to a loading station where they are applied by a bit-applying element to the backing layer. In U.S. Pat. No. Re. 27,165 two types of bit-applying elements are utilized; i.e. tufting needles and a stomper means utilized to engage a bit length of yarn and press it against the adhesive coated backing layer. In both situations, a multi-color selection of yarn bits is enabled by a magazine, thus offering a varied color selection to each of the guide tubes through which yarn is transported to the bit-applying elements in the loading position.

U.S. Pat. No. 3,554,147 shows an alternative system to that disclosed in U.S. Pat. No. Re. 27,165 which provides for the simultaneous selection of bit lengths of yarn of different colors for each tufting cycle at each individual needle station. This is accomplished by having yarn, from as many sources of color as desired, fed through channels which lead into a common channel adjacent the loading station. The capability of cutting a bit length of yarn before, during or after threading of the bit-applying means and before or during tufting is disclosed. Since the cutting function may take place in close proximity to the loading station and after a particular yarn strand has been fed into the common channel, U.S. Pat. No. 3,554,147 discloses a pull back system to remove at will the strand of yarn from the common channel leading to the loading station when a color change is desired.

The system disclosed in some embodiments of aforementioned U.S. Pat. No. 3,554,147 wherein yarn was severed into yarn bits while in tubes or channels when under the influence of pneumatic pressure, was found lacking in some aspects when employed with multicolor selection systems. Accordingly, it is one of the objectives of this invention to provide for increased utility when so employed as will be clear from the following. To admit a cutting element into a pneumatic passageway, it is necessary to have an opening through which the cutting element may operate. This very opening will diminish the efficiency of the pneumatic system if allowed to remain open during the transport of the yarn. Further, in the Spanel et al. multi-color cut-pile systems, it is desirable to have cutting means adjustable to produce variable pile heights in the manufactured rugs, such adjustment tending to also diminish pneumatic efficiency.

A need is thus present for an integrated, highly efficient system for placing a bit length of yarn in a loading position relative to a tufting member which includes: cutting the yarn into a yarn bit with a cutting means and preserving the efficiency of the pneumatic system while performing such a cutting function, such means being additionally adjustable to provide yarn bits of varying lengths; improving the efficiency of the pneumatic system at the bit applying station and, at the same time, providing means to positively control the yarn before and after tufting.

BRIEF DESCRIPTION OF THE DRAWINGS

For a more detailed understanding of the invention, reference is made in the following description to the accompanying drawings in which.

DESCRIPTION OF THE PREFERRED EMBODIMENTS

Figures 1, 1A:
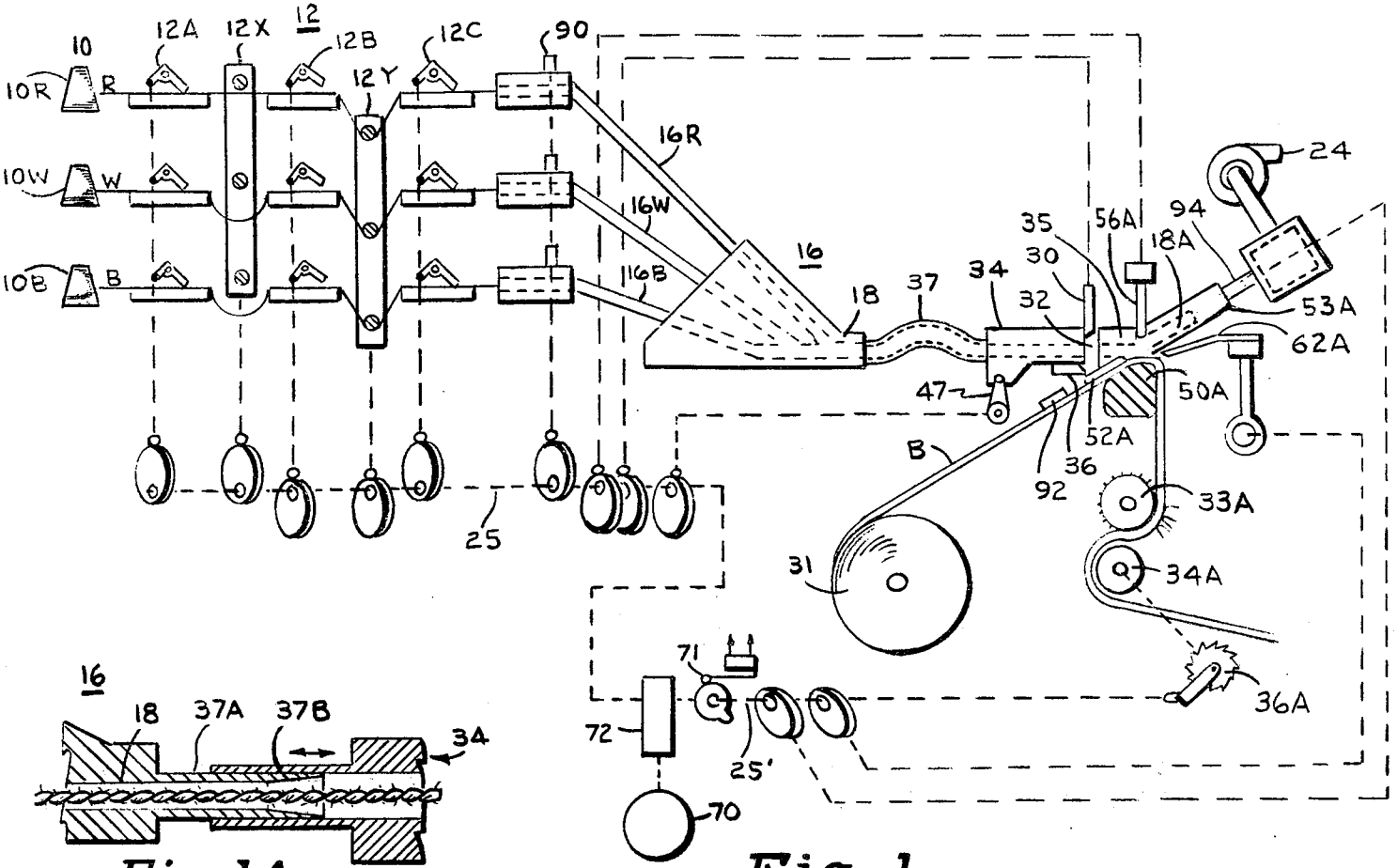
FIG. 1 is a schematic view of a tufting machine.
FIG. 1A is a partial sectional view of an alternate embodiment of a portion of FIG. 1.

In general, the subject tufting machine shown in FIG. 1 comprises a creel 10 having three spools 10R, 10W, 10B, each of differently colored yarn, a yarn metering system 12, a collator 16, a cutting station generally denoted by the severing means which may be a cutting blade 30 and anvil 36, an axially reciprocating passageway section 34, a combination bit applying and clamp means 56A and a vacuum source 24. The operation of the tufting machine is controlled by cam shafts generally designated by dotted lines 25 and 25' and various caming members located thereon.

In the operation of a preferred embodiment of the tufting machine, yarn from a creel is passed through the metering system 12 which releases a specified length of one of the yarns to collator 16 so that it passes by the cutting station and cutting blade 30 to beneath the combination bit-applying and clamp means 56A. The metering system 12 operates so that the travel of the yarn is limited insofar as the portion extending beyond the cutting blade 30 is a specified bit length. When the yarn is in place, it is clamped by the descent of combination bit-applying and clamping means 56A to prevent lengthwise movement of the yarn bit once cut and to secure the yarn bit to the backing layer B which has an adhesive gripping surface. Passageway section 34 is reciprocated in a leftward direction by a rocker arm assembly 47 and cutting blade 30 descends against anvil 36 to cut the yarn. After the cutting, the yarn remaining to the left of the cutting blade 30 is withdrawn into collator 16 by part 12Y of the metering system 12. The withdrawal of the yarn into collator 16 allows a change of yarn color if desired for the next tufting cycle. The yarn on the right of the cutting blade 10, which has been cut into a discrete bit, is tufted and tuft clearing bar 52A acts in concert with tuft retaining bar 62A to clear the path for the next tufting operation.

In more detail and again with reference to FIG. 1, creel 10 is shown having three spools 10R, 10W, 10B, respectively providing, for example, a supply source of red, white, and blue yarn. While yarn sources for three different colors are shown, it is to be understood that any number of additional yarn colors may be supplied as desired. Also, yarns differing in other than color may be employed.

The yarn strands R, W, and B are led into metering device 12 which comprises a plurality of brakes 12A, 12B, and 12C and yarn pulling devices 12X and 12Y.

Briefly, puller 12Y is shown at the bottom of a stroke with brakes 12A and 12C closed and brake 12B open. In its descent, puller 12Y draws yarn from the left without restraint by opened brake 12B, but is precluded from drawing yarn from creel 10 by closed brake 12A and is precluded from withdrawing yarn from the right by closed brake 12C. Thus, yarn loops formed at the second pulling station by puller 12Y are from yarn temporarily stored at the first pulling station 12X and are available for use when the closed brake 12C is released.

A yarn strand may thus be procured from any of the sources by the release of the brake 12C for the particular strand desired. The remainder of the yarn strand after a bit-length has been removed may be pulled back from the right by closing 12B and actuating yarn puller 12Y. Thus, the yarn metering and feed system has the capability to both supply yarn and to pull part of it back from the pneumatic passageway area 18. For a more detailed description of the yarn feed system and the manner in which colored, pattern-tufting is accomplished, reference should be made to U.S. Pat. No. 3,554,147.

For each yarn supply there is a tube or passageway 16R, 16W, and 16B each forming an input passage of collator 16, the tubes of which lead into a common passageway 18 which extends by way of flexible portion 37 and through sections 34 and 35 into the tufting station.

In one embodiment, negative pressure for transporting the yarn strands from yarn-metering device 12 through the collator 16 to the tufting station may be provided by a pneumatic source 24 shown as a suction device which via suction tubes 94 is connected to passageway 18A which is an extension of passageway 18 on the far side of the tufting station from the yarn supply. The use of positive pressure or a combination of positive and cooperatively applied negative pressure may be employed to produce a flow of gas to transport the yarn.

The combination bit-applying and clamping means 56A preferably comprises individual members depending from a widthwise bar, which will be operable off of the cam shaft 25 as shown in FIG. 1.

The backing feed elements for the backing layer B include a supply roll 31, an idler roll 33A and a drive roll 34A. A ratchet and pawl mechanism 36A may be used to drive the drive roll 34A intermittently to advance the backing as the tufting is produced by the reciprocation of combination bit-applying and clamp means 56A.

Motor 70 is shown as driving the entire device through a suitable transmission 72 which may be a train of gears, timing chain, or the like. The metering mechanism 12 is shown as operating from shaft 25. Thus, with clock pulses shown shown schematically by reference numeral 71 generating a pattern readout, yarn can be supplied to the tufting station in the manner more fully described in U.S. Pat. No. 3,554,147.

The severing means or cutting blade 30 which operates from shaft 25 is shown as slightly penetrating into a knife gap or access opening 32 which is between passageway section 34 and passageway loading section 35. Anvil 36 extends beneath part of passageway section 34 protruding beneath gap 32 and is aligned with knife member 30. Passageway section 34 is laterally reciprocable or shiftable as a unit by means of shaft 44 (see FIG. 2) through rocker arm 46 connected to fixed stud 48. This mechanism 47 is shown in FIG. 1 as operating from shaft 25. The acess opening 32 may accommodate other cutting means such as oscillating knives or laser cutters, the use of each being contemplated as within the scope of the present invention.

To permit the axial shifting or reciprocation of section 34, passageway 18 is shown with flexible portion 37 (FIG. 1). This is relatively straight when the access opening 32 is closed and slacks as section 34 shifts preparatory to the thrust of cutting blade 30. An alternate embodiment to the flexible portion 37 is shown in FIG. 1A in which flexible portion 37 is replaced by telescoping members 37A and 37B. Section 34 is permitted to shift as member 37A slides into member 37B. Although not shown in FIG. 2 and succeeding figures, the yarn is in guide tubes continually from the collator 16 to the common passageways 18 which are continuous through flexible portion 37, shifting section 34 and the tufting station at loading section 35. From its entry into the collator tubes 16R, 16W, and 16B to its placement in section 35, the yarn is under the influence of pneumatic gas flow. The embodiment using telescopic tubes 37A and 37B in FIG. 1A permits the increase and decrease in total effective passageway length as section 34 reciprocates.

Intermediate backing guide 50A guides the backing beneath and in the proximity of combination bit-applying and clamp means 56A. A reciprocating tuft clearing bar 60A serves to push tufted yarn to the right as the clearing bar 60A shifts to the right to cause the tufts to be retained behind a tuft-retaining bar 62A as will be described.

Figure 2:
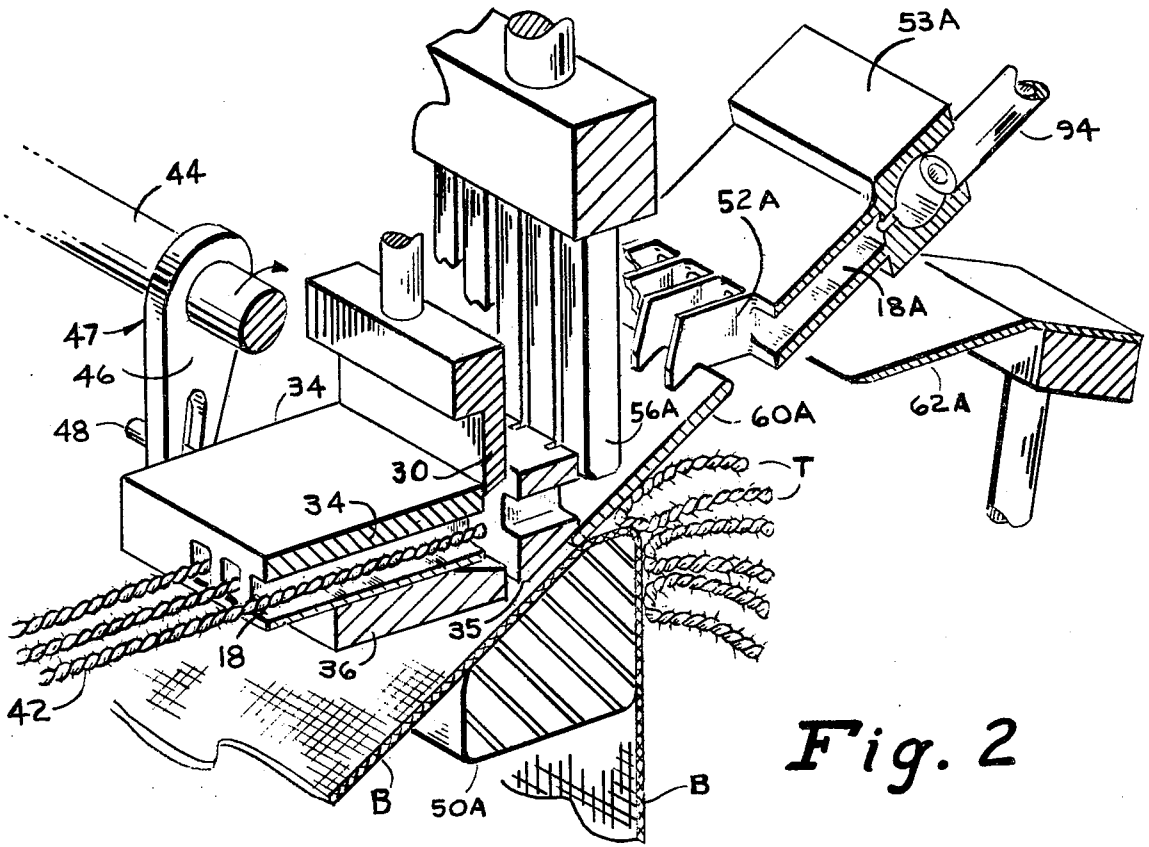
FIG. 2 is a cross-sectional perspective view of the tufting element loading station.

As best seen in FIG. 2, the tuft clearing bar 60A is a widthwise bar member which is secured to comblike structure 52A through which each individual member of the combination bit-applying and clamp means 56A extend during the tufting operation. The comblike structure 52A is joined to the block 53A in which the extensions 18A of the channels extend where the yarn feed terminates. Vacuum tubes 94 join with the channels 18A and lead to the pneumatic source 24 which is shown to be a suction valve in this embodiment.

It will be appreciated that as each combination bit-applying element and clamp means 56A engages the corresponding bit length of yarn and presses the loop portion or bottom of the U-shaped bit against the upper face of backing layer B for bonding engagement therewith, conventional bonding techniques may be used.

For example, if the backing layer B is of thermoplastic material or coated therewith, it may be activated by heat supplied via the underplate 50A at the bit-applying zone and/or the heating element 92 in advance of the bit-applying zone; in such case, setting of the bonds between the applied bits and the backing layer may be effected or accelerated by cooling beyond the bit-applying zone. In another example, a quick-setting adhesive may be applied to the upper face of the backing layer B immediately in advance of the bit-applying zone; in such case, the element 92 may be a spray heater. It is to be noted that a relatively small loop or foldover portion of each strand, sufficient for permament bonding, is pressed into a cement surface, hot or cold, or into a thermoplastic surface, or into any suitable quick-acting gripping surface which is also flexible.

Figure 3:
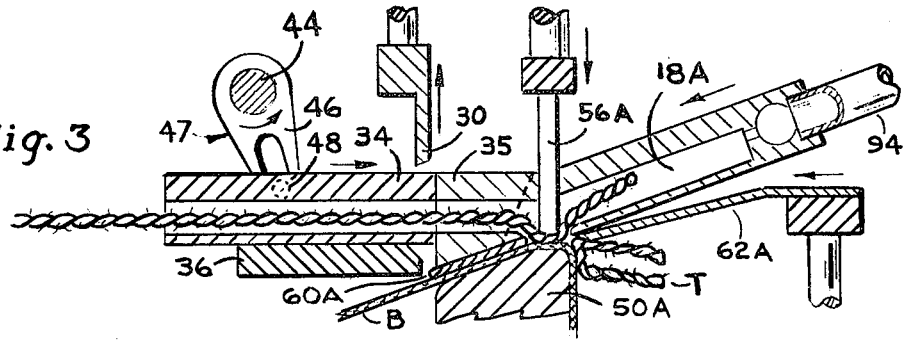
FIG. 3 is a cross-sectional side view of the tufting station showing a bit-length of yarn which has been transported to the tufting station and is shown clamped against the backing layer.

In operation, a yarn strand of the desired color, such as the strand designated 42 in FIG. 2, is chosen by a pattern readout process which may follow the teaching of aforementioned U.S. Pat. Nos. Re. 27,165 and 3,554,147. The strand is advanced from the yarn-metering device 12 by pneumatic gas flow produced either by positive pressure or negative pressure, or a combination of both. The pneumatic gas flow moves the strand beneath the combination bit-applying and clamp means 56A and into the extension channel 18A as shown in FIG. 3 with the length being predetermined and set by the yarn-metering device 12. At a time prior to cutting, the combination bit-applying means and clamp member 56A descends as shown to clamp the yarn against the backing layer B. Otherwise, when the yarn is cut, it could be influenced by the continuing pneumatic gas flow. A yarn-bit stop described subsequently may be used in conjunction with the bit-applying and clamp means 56A. It will be noted that yarn-metering device 12 allows the length of yarn to be released so that equal amounts of the yarn extend from the right yarn end to the combination bit-applying and clamp means 56A as from the combination bit-applying and clamp means 56A as from the combination bit-applying and clamp means 56A to the cutting blade 30. This is necessary if the pile height is desired to be equal for each leg.

Figure 4:
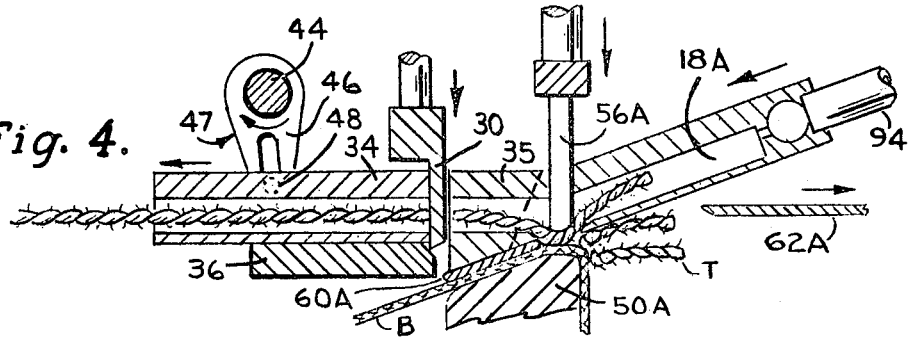
FIG. 4 is a cross-sectional side view of the tufting station showing the severing means penetrating through the access opening as a yarn bit is severed.

When the yarn is in position, reciprocating section 34 shifts to the left to open gap or access opening 32, and cutting blade 30 descends through that gap to make contact with anvil 36 as shown in FIG. 4. The yarn is thus effectively severed into a yarn bit. The yarn bit has been placed in tufting relationship with the backing layer B and is, at this time, held in place by the combination bit-applying and clamp means 56A.

Figure 5:
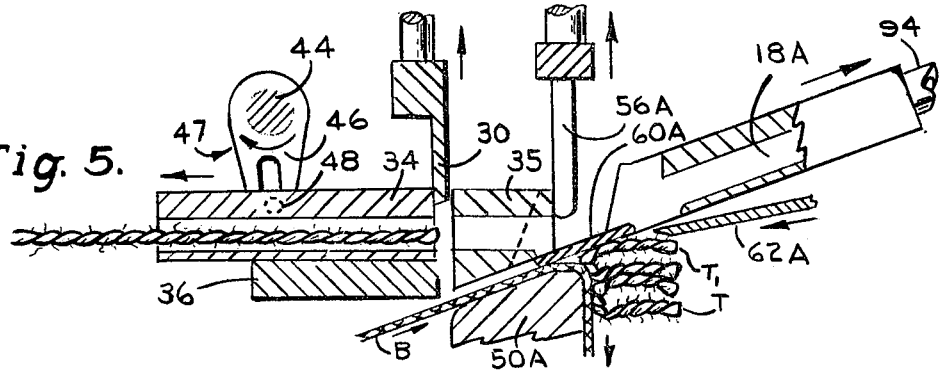
FIG. 5 is a cross-sectional side view of the tufting station showing the severing means withdrawing as the tuft clearing bar pushes the attached tuft below the tuft retaining bar as the backing layer advances.
Figure 6:
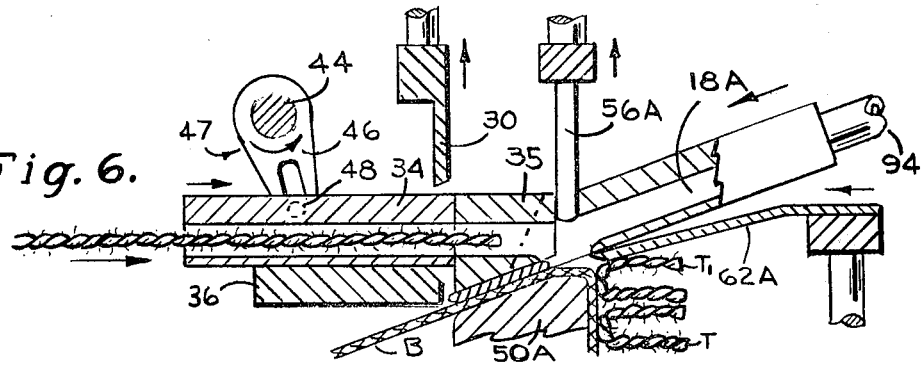
FIG. 6 shows the severing means completely withdrawn and the access opening closed as yarn is being transported to the tufting station; also the tuft clearing bar has returned to its rest position.

The cutting blade 30 now returns to its rest position (it is shown returning in FIG. 5), the combination bit-applying and clamp means 56A ascends, and the backing layer B advances simultaneously as reciprocating section 53A moves to the right, pulling with it tuft clearing bar 60A which, as shown in FIG. 5, clears the tuft from the tufting station. Simultaneously, the tuft retaining member 62A moves to the left above the attached tuft $T_1$ to secure the tuft $T_1$ to the right of the location where the succeeding tufting stroke will occur when the combination bit-applying and clamp means 56A once again descends. As shown in FIG. 6, the tuft $T_1$ is completely restrained by restraining member 62A and the reciprocating section 34 has returned to its closed position to allow the next bit length of tufting yarn to be loaded at the tufting station. As shown in FIG. 6, the yarn is progressing forward through channel 18 to the tufting position.

After a yarn bit has been severed and in preparation for the next tufting cycle, the yarn color-selection process, as descirbed in the aforementioned U.S. Pat. No. 3,554,147 will select the next yarn color and if change is to be made, the yarn strand presently in common passageway 18 from which a yarn bit has just been severed will be pulled back by the yarn pull-back mechanism 12Y at least far enough to clear the common passageway 18 and the yarn strand from the newly selected color will be fed into the tufting station through passageway 18.

The machine, as described, produces cut-pile rugs with a pile heighth being determined approximately by the distance that the yarn bit extends on each side of the combination bit-applying and clamp means 56A, the distance on each side being kept equal if pile legs of the same height are desired. On the other hand, a rug may be obtained which, for each bit-applying stroke, a short and long leg is produced by setting the yarn-metering device 12 to supply lengths of yarn which will extend a distance beyond the combination bit-applying and clamp means 56A different than the distance between the cutting blade 30 and the combination bit-applying and clamp means 56A.

The tufting machine also may be controlled to produce pile heights that differ from one operation of the machine to the next. As shown in FIG. 6, adjustment means may be provided on the cutter blade 30 and the anvil 36 to enable each of these mechanisms to be shifted to the left. The shifting block 34 may be set further to the left to create a larger access 32, thereby permitting the cutting blade 30 and anvil 36 contact to be further to the left of loading portion 35. Thus, the distance between cutting blade 30 and combination bit-applying and clamp means 56A will be increased and yarn-metering device 12 can be set to provide sufficient yarn to give an identical increased length on the far side of combination bit-applying and clamp means 56A from the yarn supply. A rug having a greater pile height will thus be produced.

Advantages may be taken of some of the features of this invention in a further embodiment wherein the yarn is severed at cutting station 90, positioned remotely from the tufting station, and operable from shaft 25 by cam means as shown schematically in FIG. 1. Since in this embodiment the yarn is cut into bits before the yarn is transported to the tufting station, it is desirable to have a stop means (not shown) to stop the movement of the yarn bit below the combination bit-applying and clamp means on the order of that which is shown in aforementioned U.S. Pat. No. Re. 27,165.

In the embodiment shown in FIGS. 3–6, the advantages of utilizing the combination bit-applying and clamp means 56A as a means to both clamp the yarn and simultaneously apply it to the backing layer B can readily be appreciated. In certain embodiments of the parent applications, Ser. Nos. 239,931 and 419,417, in which yarn bits are applied by needles, a clamping means separate and apart from the bit-applying means (needles) is utilized. Thus, efficiency can be improved where one element 56A serves as both the clamp and bit-applying means.

While various embodiments of the invention have been shown and described, it will be understood that various modifications may be made. The appended claims are, therefore, intended to define the true scope of the invention.

I claim:

1. Apparatus for producing a product by adhesively securing yarn bits to an adhesive backing layer comprising pneumatic means for conveying yarn to a bit-applying station having a passageway extending from the source of yarn to said bit-applying station, means for supplying said adhesive backing to said bit-applying station, and means for severing yarn that extends longitudinally within the passageway, wherein the passageway comprises parts relatively movable to one another between a first relationship in which access is provided to the yarn for said severing means, and a second relationship in which the passageway is substantially continuous between its ends for conveying of said yarn, means to cause relative movement of said movable passageway parts to open and close said access; said bit-applying station further comprising a combination bit-applying and clamping means reciprocable to and from said backing layer between a position in which yarn is received from said passageway and a position in which said yarn is clamped against said backing layer, and wherein clearing means are provided to clear tufted yarn out of the path of the combination bit-applying and clamp means.

2. The apparatus according to claim 1 in which the severing means is adjustable parallel to the axis of the passageway to provide yarn bits of different lengths.

3. The apparatus according to claim 1 in which at least one of said passageway parts is flexible to accommodate relative movement of the parts.

4. The apparatus according to claim 1 in which at least one of said passageway parts is telescopic whereby to accommodate relative movement of the parts.

5. The apparatus according to claim 1 wherein the clearing means are associated with a tuft-retaining means adapted to hold said tufted yarn out of the path of the combination bit-applying and clamp means.

6. The apparatus according to claim 1 including backing layer guide structure to guide the backing layer through a directional change in the proximity of said bit-applying station.

* * * * *